US005717335A

United States Patent [19]

Lee

[11] Patent Number: 5,717,335

[45] Date of Patent: Feb. 10, 1998

[54] ELECTRIC BULB SHORT DETECTION APPARATUS FOR TRAFFIC SIGNAL CONTROLLER

[75] Inventor: Jeong Jun Lee, Anyang, Rep. of Korea

[73] Assignee: Lg Industrial Systems, Co., Ltd., Seoul, Rep. of Korea

[21] Appl. No.: 609,923

[22] Filed: Feb. 29, 1996

[30] Foreign Application Priority Data

Mar. 4, 1995 [KR] Rep. of Korea ..... 4461/1995

[51] Int. Cl.[6] ..... G08G 1/09

[52] U.S. Cl. ..... 324/414; 340/642

[58] Field of Search ..... 340/641, 642, 340/643; 324/414

[56] References Cited

U.S. PATENT DOCUMENTS

| | | | |
|---|---|---|---|
| 4,295,079 | 10/1981 | Otsuka | 340/642 |
| 4,330,778 | 5/1982 | Yamazaki | 340/642 |
| 4,451,822 | 5/1984 | Verse | 340/642 |
| 5,034,659 | 7/1991 | Taniguchi | 340/642 |
| 5,387,909 | 2/1995 | Neel | 340/642 |
| 5,581,229 | 12/1996 | Hunt | 340/642 |

*Primary Examiner*—Ernest F. Karlsen
*Assistant Examiner*—Jose M. Solis
*Attorney, Agent, or Firm*—Oliff & Berridge, P.L.C.

[57] ABSTRACT

An improved electric bulb short detection apparatus for a traffic signal controller capable of preventing an erroneous detection of an electric bulb short which is caused due to a voltage variation and the like, which includes an electric power control unit for driving a traffic signal light in response to an alternating current voltage supplied thereto; a voltage comparison circuit for comparing the the outputted voltage from an AC voltage source voltage with a reference voltage; a current detection unit for detecting a current of the electric power control unit in response to a comparison output signal from the voltage comparison circuit and for digitally-converting the current; and a central processing unit for judging whether an electric bulb is short by comparing a detection current value outputted from the current detection unit at every control step with a reference value and for controlling an electric power control circuit.

6 Claims, 5 Drawing Sheets

FIG.3A
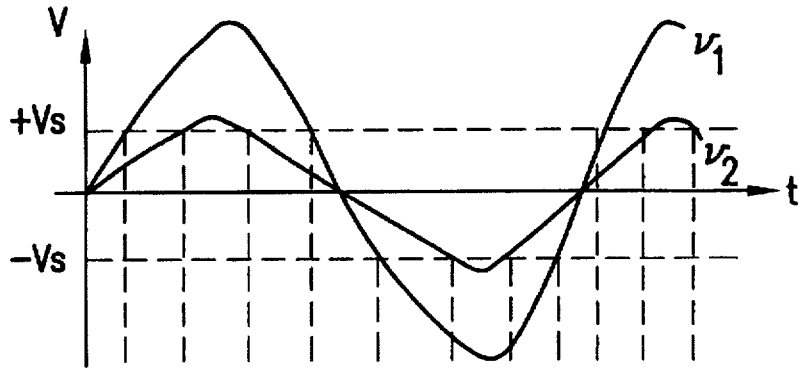
FIG.3B
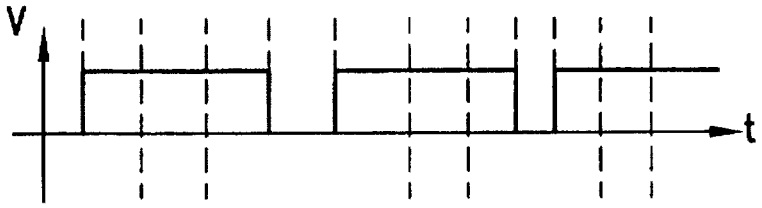
FIG.3C
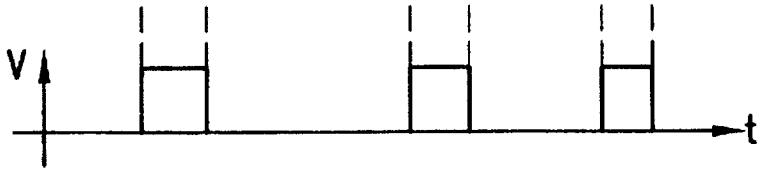
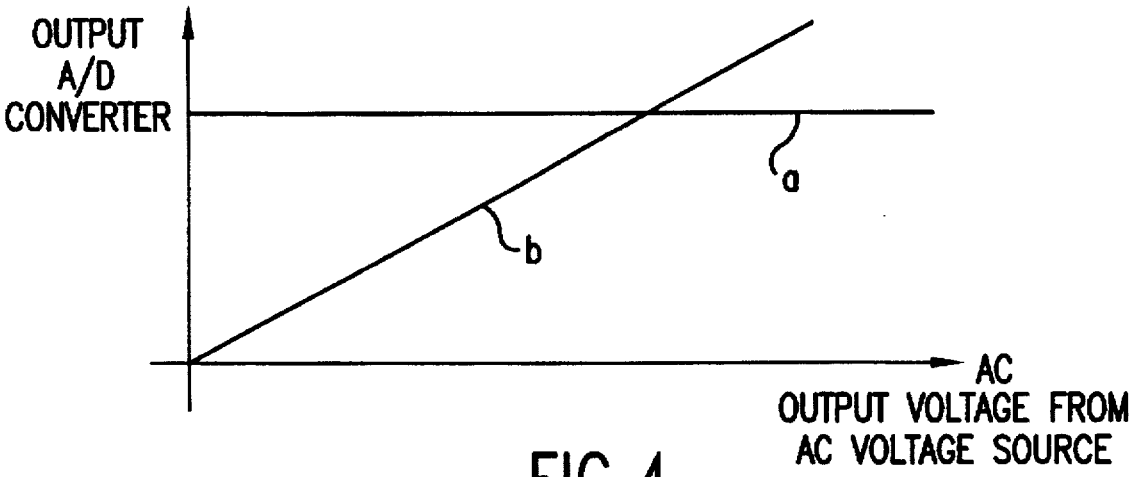
FIG.4

ELECTRIC BULB SHORT DETECTION APPARATUS FOR TRAFFIC SIGNAL CONTROLLER

BACKGROUND OF THE INVENTION

1. Field of Invention

The present invention relates to an electric bulb short detection apparatus for a traffic signal controller, and particularly to an improved electric bulb short detection apparatus for a traffic signal controller capable of preventing an erroneous detection of an electric bulb short which is caused due to a voltage variation and the like.

2. Description of Related Art

The electric bulb short detection function for a traffic signal controller is generally directed to preventing erroneous operations of the traffic signal controller and facilitating a rapid maintenance thereof thus preventing traffic accidents.

However, there are various problems so as to properly detect an electric bulb short, so that it is difficult to effectively prevent traffic accidents due to the problems.

Among the problems, the most serious problem is an error operation due to an unstable voltage supply to the system which is caused, for example, by the growing number of factories or large-voltage-requiring buildings at location(s) near the traffic signal controller.

FIG. 1 shows an electric power control unit 20 for driving a traffic signal light 10 by receiving an outputted voltage from an AC voltage source AC, a current detection circuit unit 30 for detecting a current of the electric power control unit 20 and for converting the outputted voltage from an AC voltage source into a digital voltage, and a central processing unit (CPU) 40 for comparing the voltage digitally-converted by the current detection unit 30 with a reference voltage, judging whether an electric bulb is short, and controlling the electric power control unit 20.

The electric power control unit 20 is provided with a plurality of electric power controllers, and each electric power controller generally has 2–5 electric bulbs connected to one another in parallel.

In addition, the current detection unit 30, which is connected to a plurality of electric power controllers of the electric power control unit 20, respectively, includes a plurality of current transformers C/T for detecting current of each electric power controller, a plurality of electric power conversion units for converting the detected current into a predetermined voltage, and a plurality of A/D converters for converting the output voltage of the voltage conversion units into a digital signal.

The operation of the conventional electric bulb short detection apparatus for a traffic signal controller will now be explained with reference to the accompanying drawing.

To begin with, when the outputted voltage from an AC voltage source AC is applied to the system, the electric power control unit 20 turns on/off the supply voltage of the traffic signal light 10 in accordance with the CPU 40, so that the traffic signal light 10 is turned on/off.

At this time, the current transformers C/T of the current detection unit 30 detect current of the electric power controllers and the thusly detected current is converted into a direct current voltage by the voltage conversion unit and eventually inputted to the CPU 40.

Therefore, the CPU 40 compares the digital signal with a previously set reference value or with a digital signal detected during a previous control process, and judges whether an electric bulb is short in accordance with the comparison. In addition, the CPU 40 analyses a digital signal outputted from the current detection unit 30 at each traffic signal control and judges whether an electric bulb is short.

However, the conventional electric bulb short detection apparatus for a traffic signal controller has disadvantages in that it is reliable only when an alternating current voltage supply is stable or there is a small variation of the outputted voltage from an AC voltage source AC.

In addition, in case that the outputted voltage from an AC voltage source AC varies, it is impossible to judge whether the variation of the current value is based on the variation of the resistance value or whether the variation of the current value is based on the variation of the outputted voltage from an AC voltage source AC. In particular, if there are large-electric power-requiring facilities located near a traffic signal light, it is hard to accurately detect whether or not an electric bulb is short due to the unstable variation of the outputted voltage from an AC voltage source AC supplied to the system.

SUMMARY OF THE INVENTION

Accordingly, it is an object of the present invention to provide an electric bulb short detection apparatus for a traffic signal controller which overcomes the problems encountered in a conventional electric bulb short detection apparatus for a traffic signal controller.

It is another object of the present invention to provide an improved electric bulb short detection apparatus for a traffic signal controller capable of preventing an erroneous detection of an electric bulb short which is caused, for example, due to a voltage variation of an AC voltage source.

To achieve the above objects, there is provided an electric bulb short detection apparatus for a traffic signal controller, which includes an electric power control unit controlled by the outputted signal from a CPU and for driving a traffic signal light in response to the outputted voltage from an AC voltage source supplied thereto; a voltage comparison circuit for comparing the outputted voltage from an AC voltage source with a reference voltage; a current detection unit for detecting a current of the electric power control unit in response to a comparison output signal from the voltage comparison circuit and for digitally-converting the current; and a central processing unit for judging whether an electric bulb is short by comparing a detection current value outputted from the current detection unit at every control step with a reference value and for controlling an electric power control circuit.

BRIEF DESCRIPTION OF THE DRAWINGS

FIGS. 3A through 3C are wave forms of a comparison signal with respect to the outputted voltage from an AC voltage source AC.

FIG. 4 is a graph showing outputs of an A/D converter according to the present invention and a conventional A/D converter.

DETAILED DESCRIPTION OF PREFERRED EMBODIMENTS

Figure 1:
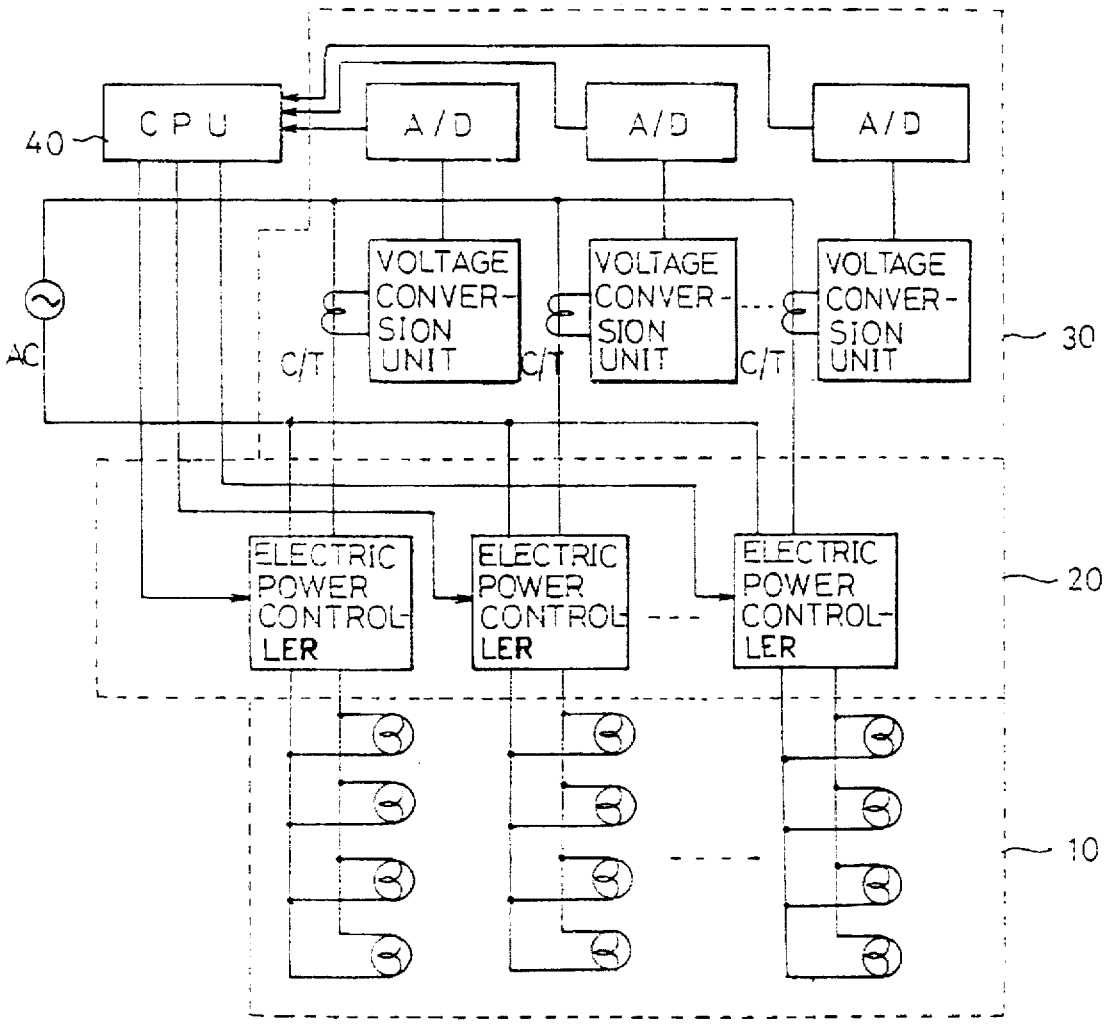
FIG. 1 CONVENTIONAL ART
FIG. 1 is a block diagram of a conventional electric bulb short detection apparatus for a traffic signal controller.
Figure 2:
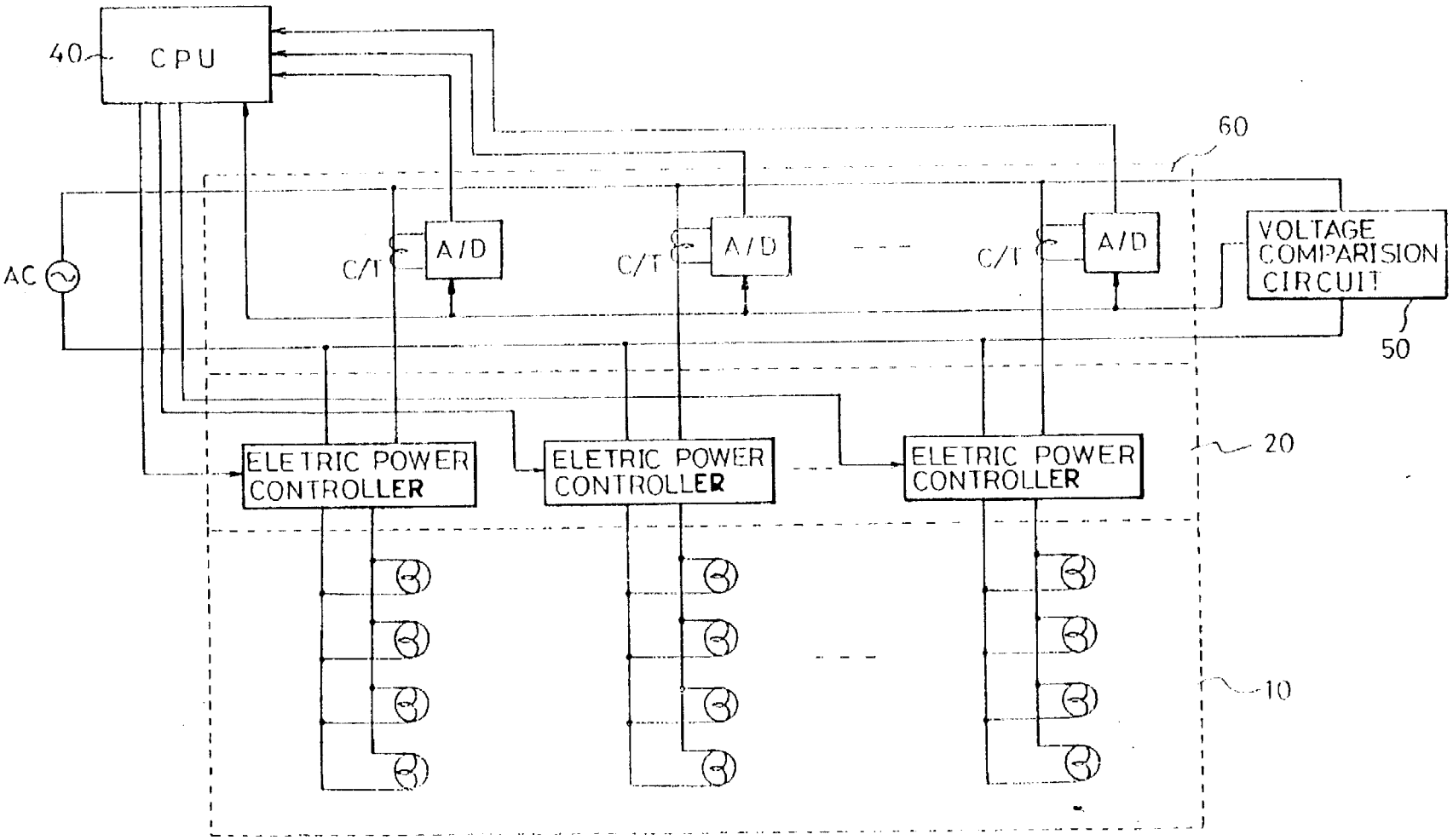
FIG. 2 is a block diagram of an electric bulb short detection apparatus for a traffic signal controller of a first embodiment according to the present invention.

FIG. 2 shows an electric bulb short detection apparatus for a traffic signal controller of a first embodiment according to the present invention, which includes an electric power control unit 20 controlled by the outputted control signal from a CPU 40 and for driving a traffic signal light 10 in response to the outputted voltage from an AC voltage source AC supplied thereto, a voltage comparison circuit 50 for comparing the outputted voltage from an AC voltage source AC with a reference voltage, a current detection unit 60 for detecting a current of the electric power control unit 20 in response to a comparison output signal from the voltage comparison circuit 50 and for converting the current into a digital signal voltage, and a central processing unit (CPU) 40 for comparing the current value outputted from the current detection unit 60 with a reference voltage and for judging whether or not an electric bulb is short and for controlling the electric power control unit.

The electric power control unit 20 consists of a plurality of voltage controllers and 2–5 electric bulbs, for example, are connected to the voltage controllers.

In addition, the current detection unit 60, which is connected to a plurality of electric power controllers of the electric power control units 20, includes a plurality of current transformers C/T for detecting a current flowing to the electric power controllers, and a plurality of A/D converters for converting the current detected by the current transformer into a digital signal.

The operation of the electric bulb short detection apparatus for a traffic signal control according to the present invention will now be explained with reference to the accompanying drawings.

To begin with, referring to FIG. 3A, when the outputted voltage from an AC voltage source AC is supplied to the system, the electric power control unit 20 turns on/off the supply voltage of the traffic signal light 10 in response to a control of the CPU 40, so that the electric bulbs of the traffic signal light 10 are turned on/off.

At this time, the voltage comparison circuit 50 compares alternating current voltages v1 and v2 with a reference voltage ±Vs, and transmits a comparison output signal to the CPU 40 and the current detection unit 60, respectively, when the level of the alternating current voltages v1 and v2 exceed the level of the reference voltage ±Vs.

In addition, the current transformers C/T of the current detection unit 60 detect a current of the electric power controllers, and the A/D converters convert the detected current into a digital signal voltage in response to a comparison signal outputted from the voltage comparison circuit 60 and outputs to the CPU 40.

At this time, as shown in FIG. 4, the output of the A/D converters at a normal state has a constant value irrespective of the increase of the outputted voltage from an AC voltage source AC.

Therefore, the CPU 40 compares the current value digitally-converted by the A/D converters with a reference value, and judges whether an electric bulb, which is regularly turned on/off, is short.

Figures 5A, 5B, 5C, 5D:
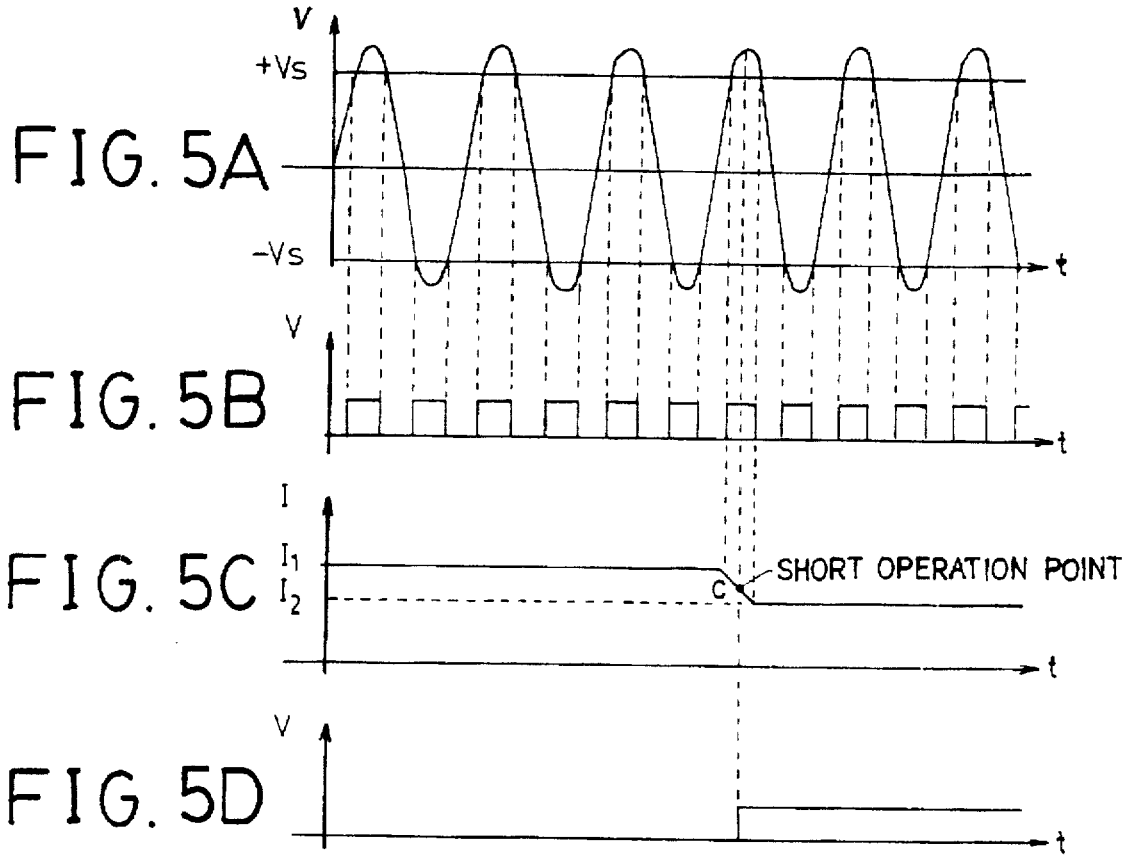
FIGS. 5A through 5D are wave forms of a detection signal of an electric bulb short according to the present invention.

That is, as shown in FIG. 5A, the outputted voltage from an AC voltage source AC is applied to the system, the electric power control unit 20 regularly turns on/off the traffic signal light 10 in accordance with a control of the CPU 40, and the voltage comparison circuit 50 compares the outputted voltage from an AC voltage source with a previously set reference voltage ±Vs, and outputs a comparison signal as shown in FIG. 5B.

At this time, the current transformers C/T of the current detection unit 60 detect a current of the electric power controllers based on Ohm's law "V=IR, I=V/R", and the detected current value computed based on the above-mentioned Ohm's law is low because the combined resistance value of the electric bulbs which are parallely connected to one another is high when the electric bulb short occurs at the traffic signal light 10.

Thereafter, the A/D converters receive a current value from the current transformers C/T, and convert the current value into a digital signal at every comparison signal as shown in FIG. 5B, and output the current value as shown in FIG. 5C to the CPU 40.

The CPU 40 compares the current value digitally-converted by the A/D converters with a previously set reference value, judges that the electric bulb short didn't occur when the current value is higher than the reference value, judges that the electric bulb short occurred when the current value is lower than the reference value, that is, at a point "c", and outputs an electric bulb short detection signal as shown in FIG. 5D to the electric power control unit 20.

Figure 6:
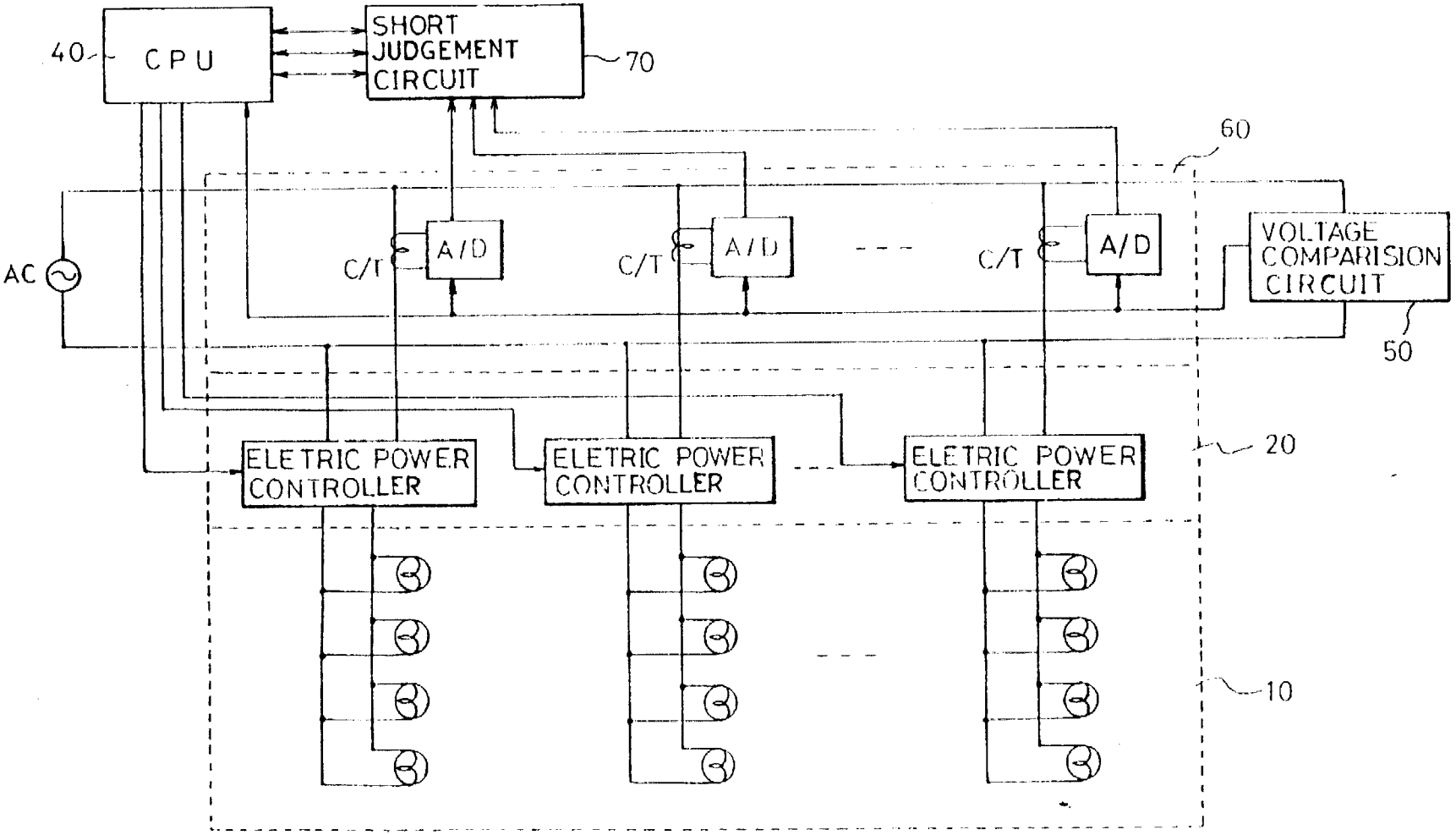
FIG. 6 is a block diagram of an electric bulb short detection apparatus for a traffic signal controller of a second embodiment according to the present invention.

In addition, FIG. 6 shows an electric bulb short detection apparatus for a traffic signal controller of a second embodiment according to the present invention, which is directed to judging whether an electric bulb is short by providing an electric bulb short judgment circuit 70 and a CPU 40 for controlling a control operation in accordance with a judging signal outputted from the electric bulb short judgment circuit 70.

The CPU 40 controls the electric power control unit 20 and outputs information with respect to the entire operation of the system, when the traffic signal light 10 is driven, to the electric bulb short judgment circuit 70, and the current detection unit 60 detects a current with respect to the outputted voltage from an AC voltage source AC in response to a comparison output signal outputted from the voltage comparison circuit 50 and outputs it to the electric bulb short judgment circuit 70.

Therefore, the electric bulb short judgment circuit 70 compares the current value detected at every driving process of the CPU 40 with a reference value, judges that an electric bulb short didn't occur when a current value I1, as shown in FIG. 5B, higher than the reference value is detected, and after a point "c" where the current value is lower than the reference value the electric bulb short judgment circuit 70 outputs an electric bulb short detection signal to the CPU 40, and the CPU 40 controls the electric power control unit 20.

As described above, the electric bulb short detection apparatus for a traffic signal controller according to the present invention is directed to preventing an erroneous operation of the system due to a voltage variation by comparing a current value of electric bulbs at a specific voltage level ±Vs irrespective of the outputted voltage from an AC voltage source AC supplied thereto with a reference value and judging whether an electric bulb is short.

In addition, it is possible to detect a current value in response to a variation of an electric bulb resistance without performing a complex operation so as to compensate for a current data, so that a more accurate electric bulb short detection is possible.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. An electric bulb short detection apparatus for use with a traffic signal light controller, comprising:

a central processing unit for judging whether a traffic signal light is shorted and for outputting a control signal;

an alternating current voltage source for outputting a voltage;

an electric power control unit operably connected to said alternating current voltage source and said central processing unit for driving the traffic signal light in accordance with the control signal outputted from the central processing unit and the voltage outputted from the alternating current voltage source supplied thereto;

a voltage comparison circuit operably connected to said alternating current voltage source for comparing said outputted voltage from the alternating current voltage source with a reference voltage and for outputting a comparison output signal; and a current detection unit operably connected to said electric power control unit, said voltage comparison circuit and said central processing unit for detecting a current of said electric power control unit in response to the comparison output signal from said voltage comparison circuit and for digitally-converting the detected current to output a detection current value;

wherein the central processing unit compares the detection current value outputted from said current detection unit with a reference value.

2. The apparatus of claim 1, wherein said current detection unit includes a current transformer for detecting a current of the electric power control unit, and an A/D converter for converting the detected current into a digital signal in response to a comparison output signal from the voltage comparison circuit.

3. The apparatus of claim 1, wherein said apparatus further includes an electric bulb short judgement circuit operably connected to the central processing unit and the current detection unit for judging whether an electric bulb is shorted at every control step.

4. An electric bulb short detection apparatus for use with a traffic signal light controller, comprising:

central processing means for judging whether a traffic signal light is shorted and for outputting a control signal;

means for outputting an alternating current voltage;

means for electrically driving a traffic signal light in accordance with the control signal of said central processing means and the voltage outputted from the voltage outputting means supplied thereto, said electrical driving means being operably connected to said central processing means and said voltage outputting means;

means for comparing said outputted voltage from the voltage outputting means with a reference voltage and for outputting a comparison output signal, said voltage comparison means being operably connected to said voltage outputting means; and means for detecting a current of said electrical driving means in response to the comparison output signal from said voltage comparing means and for digitally-converting the detected current to output a detection current value, said current detecting means being operably connected to said electrical driving means, said voltage comparison means and said central processing means;

wherein the central processing means compares the detection current value outputted from said current detecting means with a reference value.

5. The apparatus of claim 4, wherein said current detecting means includes a current transforming means for detecting a current of the electrical driving means, and an A/D converting means for converting the detected current into a digital signal in response to the comparison output signal from the voltage comparing means.

6. The apparatus of claim 4, wherein said apparatus further includes means coupled to the central processing means and the current detecting means for judging whether an electric bulb is shorted at every control step.

* * * * *